United States Patent [19]

Dixon

[11] 3,936,216

[45] Feb. 3, 1976

[54] BLADE SEALING AND RETAINING MEANS

[75] Inventor: James T. Dixon, Tequesta, Fla.

[73] Assignee: United Technologies Corporation, Hartford, Conn.

[22] Filed: Mar. 21, 1974

[21] Appl. No.: 453,441

[52] U.S. Cl. ..... 415/116; 416/97 R

[51] Int. Cl.[2] ..... F04D 31/00; F01D 5/00

[58] Field of Search ..... 415/115, 116; 416/95, 96, 416/97

[56] References Cited

UNITED STATES PATENTS

| | | | |
|---|---|---|---|
| 3,501,249 | 3/1970 | Scalzo et al. | 416/95 |
| 3,572,966 | 3/1971 | Borden et al. | 416/95 |
| 3,644,058 | 2/1972 | Barnabel et al. | 416/95 |

FOREIGN PATENTS OR APPLICATIONS

| | | | |
|---|---|---|---|
| 590,513 | 1/1960 | Canada | 416/95 |

*Primary Examiner*—Henry F. Raduazo
*Attorney, Agent, or Firm*—Jack N. McCarthy

[57] ABSTRACT

An engine is shown having means for providing cooling fluid to turbine blades on a disk while providing sealing means between the blade roots and cooperating disk slots and providing means for retaining the turbine blades on their disk. The device comprises a full ring coverplate which engages a small coverplate fixed to each blade. A small coverplate is fixed, such as by bonding, to the forward end of the root section of each blade and contoured so that it extends over the edges of the root and bears against the forward side of the disk when the blade root has been inserted in a blade slot. The blades are held in the disk by the full ring coverplate which engages all of the small coverplates at a midpoint between the inner and outer ends of the root. The position of the full ring coverplate can be adjusted to provide and vary a biasing force against the small coverplates to maintain a force keeping the small coverplates against the disk. Cooling air is injected at the inner diameter of the full ring coverplate and is directed to a hole in each of the small coverplates which permits the cooling air to enter the inside of the hollow blade. The full ring coverplate also acts as a forward disk seal.

6 Claims, 3 Drawing Figures

BLADE SEALING AND RETAINING MEANS

The invention herein described was made in the course of or under a contract with the Department of the Air Force.

BACKGROUND OF THE INVENTION

This invention relates to turbine blade seals and turbine blade retaining means, particularly for use in a gas turbine engine. Examples of the prior art are shown in U.S. Pat. Nos. 2,598,176; 3,266,770; 3,644,058 and 3,715,170.

SUMMARY OF THE INVENTION

A primary object of the present invention is to provide means for directing cooling air into turbine blades on a disk while providing a seal between the turbine blades and the disk and providing means for retaining the roots of the blades in the root slots in the disk.

In accordance with the present invention a small coverplate is fixed to the forward end of the root section of each blade, such as by bonding, and contoured to extend over the edges of the root and bear against the forward edge of the disk to seal the area between the root and disk slot, and position the blade in the disk.

In accordance with a further aspect of the invention a full ring coverplate engages all of the small coverplates at a midpoint to force the small coverplates against the disk. Means are provided to vary the force exerted against the small coverplates. It is an object of this invention to have the full ring coverplate also act as a forward disk seal.

It is an object of this invention to provide a blade sealing and retaining means for blades on turbine rotors for small gas turbine engines where the rotor speeds are high and disk stresses do not permit a bolted-on type of coverplate. An engine of this size is discussed in U.S. Pat. No. 3,749,514.

DESCRIPTION OF THE PREFERRED EMBODIMENT

Figure 1:
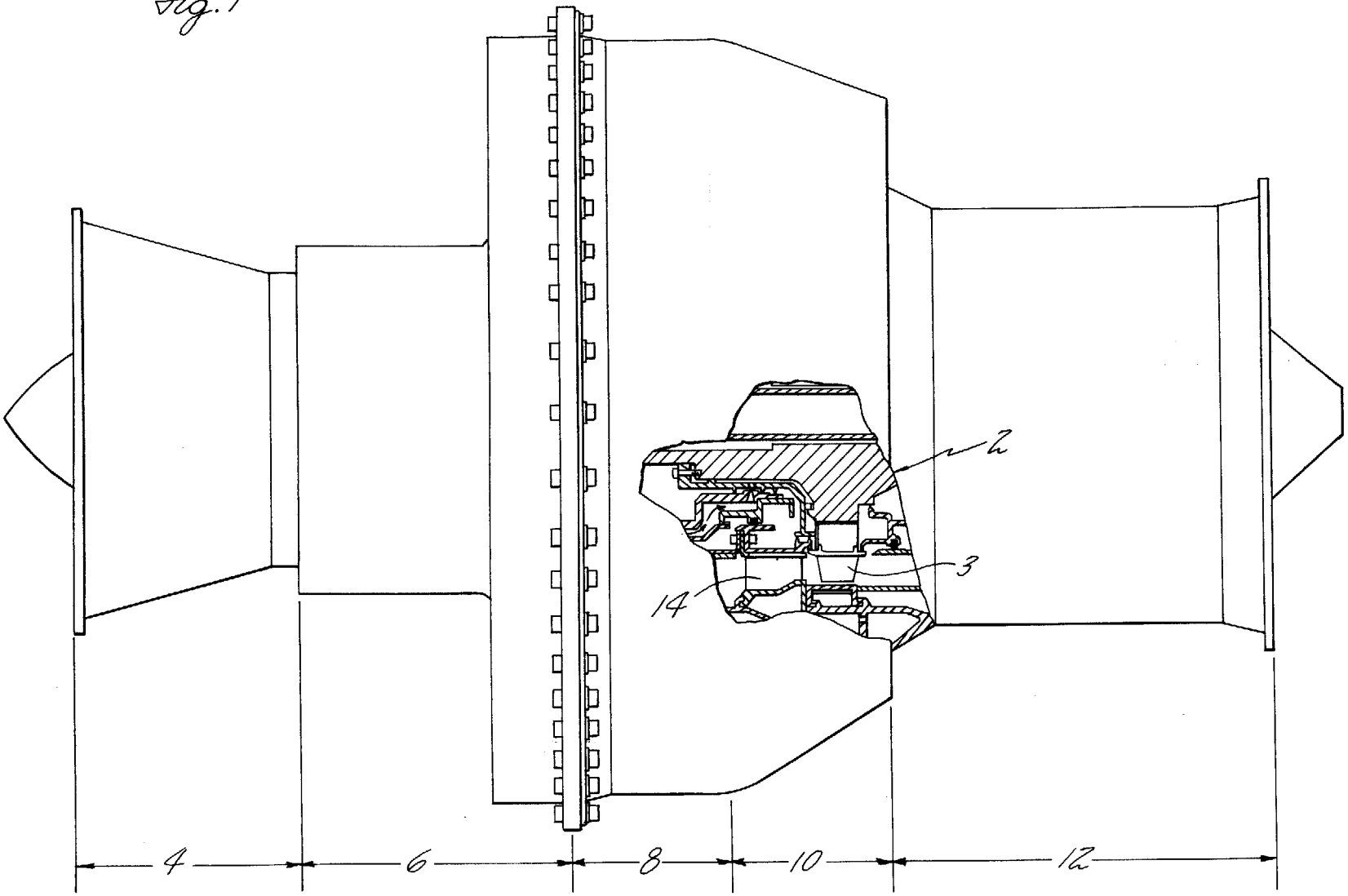
FIG. 1 is an external side view of an engine with a section broken away to show the location of the invention.
Figure 2:
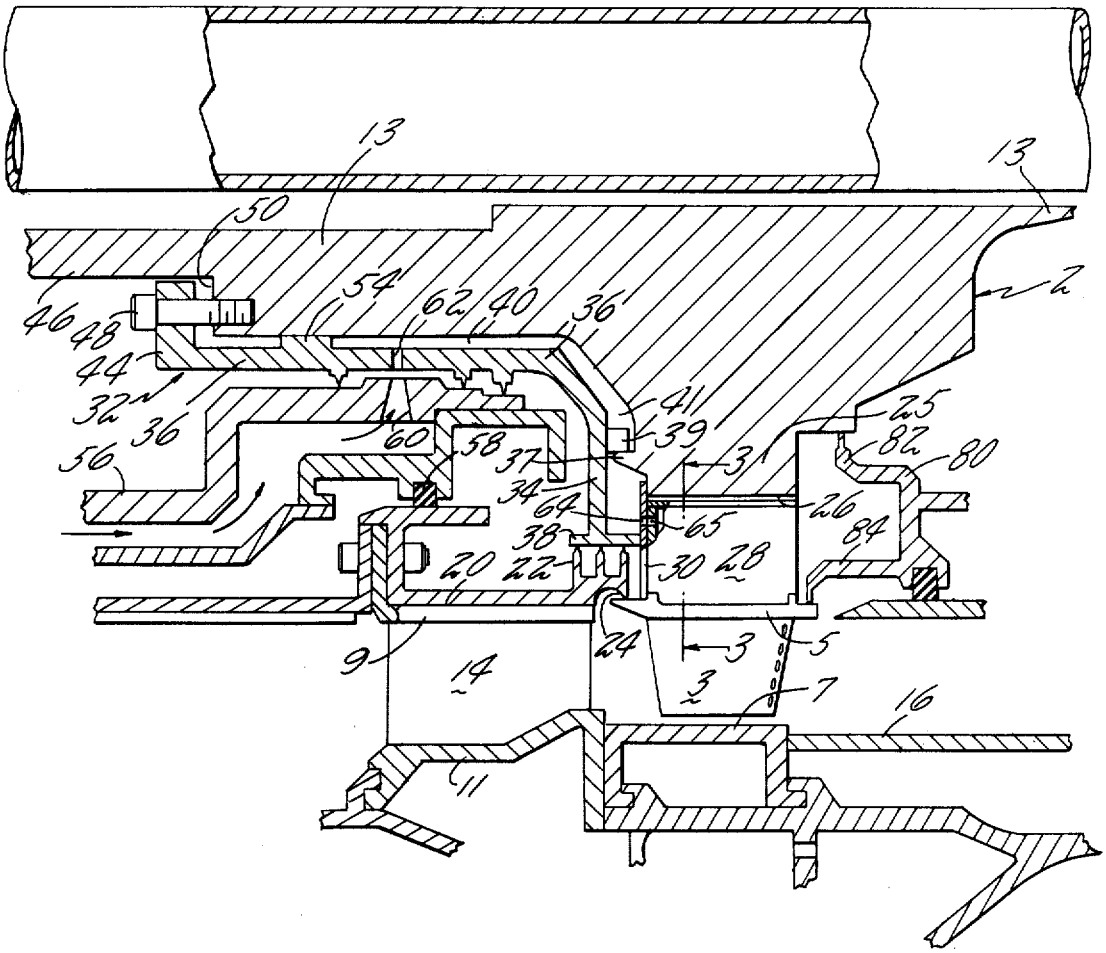
FIG. 2 is an enlarged view of the rotor and sealing and retaining means of FIG. 1.
Figure 3:
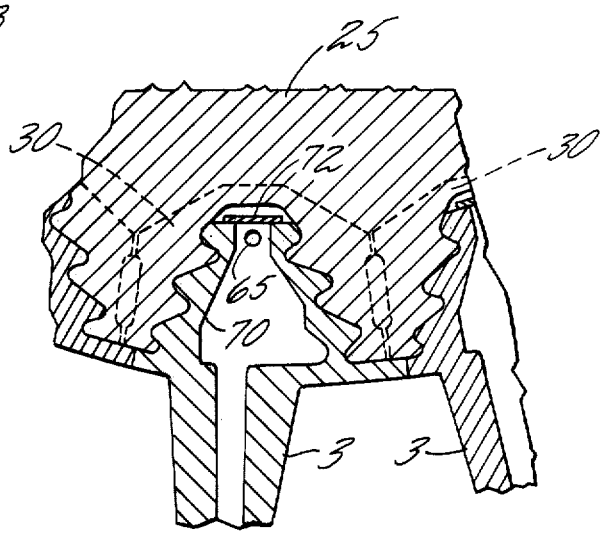
FIG. 3 is a view taken along the line 3—3 of FIG. 2 showing the sealing and retaining means.

Referring to FIG. 1, engine 1 is shown having an inlet section 4, a compressor section 6, combustion section 8, a turbine section 10 and an exhaust section 12. The turbine section 10 has a rotor assembly 2 with a shaft 13 mounted for rotation on bearings (not shown) within the engine 1. Rotor assembly 2 includes turbine blades 3 for receiving a gas flow from the combustion section 8, said gases passing over vanes 14. The vanes 14 have inner and outer annular shrouds 9 and 11, respectively, defining an annular passageway connected to said combustion section for delivering a fluid flow therefrom to said blades 3. Blades 3 are located between an inner rotating annular member 5 formed by the blade platforms and an outer shroud member 7 formed by a blade tip sealing means. One modification of a blade tip sealing means is shown in U.S. Pat. No. 3,742,705. Fluid from the blades is directed to the exhaust section 12 by an exhaust duct 16.

Outer shroud 11 is fixed to the housing of turbine section 10 while the inner shroud 9 is fixedly positioned by the vanes 14. An annular sealing member 20 is fixed to the inner shroud 9 and includes annular sealing edges 22 which extend inwardly for sealing cooperation with a rotating cylindrical surface which will be hereinafter described. Said annular sealing member 20 also has an outwardly extending sealing edge 24 which performs a sealing function with the forward inner surface formed by the blade platforms.

Rotor assembly 2 is formed having a disk 25 with slots 26 located around the periphery thereof, each slot 26 receiving a root section 28 of a blade 3. A small coverplate 30 is fixed, such as by bonding, to the forward end of the root section 28 of each blade 3 and contoured so that it extends over the periphery of the root section and bears against the forward side of the disk when a blade root section 28 has been properly inserted in a slot 26. Adjacent edges of adjacent small coverplates 30 are shaped so that there will be no overlapping.

A full ring coverplate 32 is formed having an outwardly extending flange member 34 for positioning adjacent to and spaced from the forward part of the disk 25 and small coverplates 30. A cylindrical section 36 is connected to the inner end of the flange member 34 and positioned around the rotor shaft 13 providing an annular passageway 40.

Disk 25 has an annular flange 37 located on the forward face thereof for locating and radially supporting the flange member 34 of the full ring coverplate 32 during rotation. A plurality of projections 39, arranged in a circumferential row around the rear face of the flange member 34, engage the inner surface of the flange 37. The annular flange 37 and the projections 39 are prevented from axially engaging the flange member 34 or the disk 25, respectively, by means to be hereinafter described. The full ring coverplate 32 has a cylindrical member 38 connected to the end of the flange 34 to provide for proper positioning of the flange 34 of the full coverplate and provide for the sealing at the outer edge of the flange of the coverplate.

The cylindrical member 38 has its outer surface positioned for rotating sealing cooperation with the inner annular sealing edges 22 of annular seal member 20 to prevent leakage thereby. The rearward end of the cylindrical member 38 is positioned against the forward surfaces of the small coverplates 30 thereby holding the small coverplates 30 into sealing engagement with the forward portion of the disk 25 adjacent the slots 26 and forming a seal between the end of the cylindrical member 38 and the forward mating surface of the small coverplates 30. The cylindrical member 38 is made of a predetermined length to provide a radial passageway 41 connecting the annular passageway 40 to the inner surface of the cylindrical member 38 and prevent flange 37 from engaging the flange member 34 and the projections from engaging the disk 25.

The cylindrical section 36 is formed having an inwardly extending flange 44 which extends into a necked down portion 46 on the forward part of the rotor shaft 13. A plurality of bolt means 48 are located around the flange 44 and are bolted into a radial surface 50 on the shaft 13. It can be seen that the amount of force applied to the small coverplates 30 through the end of the cylindrical member 38 of the full ring coverplate 32 can be varied by changing the position of the bolt means 48.

The cylindrical section 36 has a second inwardly extending flange 54 adjacent flange 44 which contacts the rotor shaft 13. This flange 54 serves to guide the cylindrical section 36 on the rotor shaft 13 and also to provide a seal for the cooling fluid directed into passageway 40.

A passageway means 56 extends into the area between the cylindrical section 36 and annular seal member 20, for delivering a cooling fluid for the blades 3. Stationary seal 58 is formed between passageway means 56 and seal member 20 and rotating sealing means are formed between cylindrical section 36 and the passageway means 56 on both sides of passageways 60 and 62 of passageway means 56 and cylindrical section 36, respectively. It can be seen that this arrangement permits cooling air in the passageway means 56 to be directed into the annular passageway 40.

The cooling fluid passes from annular passageway 40 to radial passageway 41 to the area formed between the outer end of flange member 34, cylindrical member 38 and small coverplates 30. The cooling air then passes through an opening 64 in each of the small coverplates 30 which is placed in line with an opening 65 in the forward end of the root section 28 of its cooperating blade 3, where it passes into the hollow blade. The cooling air then passes through the blade and out openings adjacent the trailing edge thereof. While a blade having a single cavity 70 has been shown with a plate 72 brazed to the bottom of the blade to contain cooling air within the cavity 70, it is to be understood that blades having other types of interior cavity design can be used.

A sealing member 80 is connected to fixed structure of the engine and includes a sealing ring 82 which performs a sealing function with the rotating disk 25 and a second sealing ring 84 which cooperates with the rearward inner surface formed by the blade platforms to provide a seal.

I claim:

1. In combination, a rotor disk mounted for rotation, said rotor disk having slots provided in the periphery thereof, rotor blades, said rotor blades having root portions shaped to fit the slots in the periphery of the disk, each blade having a small coverplate fixed to its root portion, each small coverplate being contoured so that it extends over the edges of its blade slot for bearing against the side of the disk and having inner and outer edges, a full ring coverplate being positioned adjacent said rotor disk said full ring coverplate having a cylindrical member extending therefrom which engages all of the small coverplates at a point between the inner and outer edges of the root portions and means for providing a biasing force against the small coverplates through said cylindrical member.

2. A combination as set forth in claim 1 wherein means are included to move said full ring coverplate axially with relation to said disk to control the biasing force against the small coverplates.

3. A combination as set forth in claim 1 wherein said blades are hollow to receive a cooling fluid, a passageway being formed between said full ring coverplate and said rotor disk for delivering a cooling fluid to the small coverplates at a point inwardly from said cylindrical member, each root portion having a first opening in the part covered by its cooperating small coverplate, each small coverplate having a second opening therein aligned with the first opening in said blade for directing the cooling fluid through the second and first openings in said small coverplates and blade root portions to the interior of the blades.

4. A combination as set forth in claim 1 wherein a fixed annular sealing member is positioned adjacent said cylindrical member and said rotor blades, said sealing member cooperating with the cylindrical member and said blades to prevent leakage therebetween.

5. A combination as set forth in claim 1 wherein said rotor disk has an annular flange projecting from the face thereof, said full ring coverplate having a centrifugal row of projections extending towards said disk for engaging the inner side of said flange thereby providing radial support for said full ring coverplate during rotation of the disk.

6. A combination as set forth in claim 2 wherein said means to move said full ring coverplate axially includes bolt means which extend through said full ring coverplate into said rotor disk.

* * * * *